US005083137A

United States Patent [19]

Badyal et al.

[11] Patent Number: 5,083,137

[45] Date of Patent: Jan. 21, 1992

[54] ENERGY CONTROL CIRCUIT FOR A THERMAL INK-JET PRINTHEAD

[75] Inventors: Rajeev Badyal; Sam Mahjouri; Donald M. Reid; Michael J. Gilsdorf, all of Corvallis, Oreg.

[73] Assignee: Hewlett-Packard Company, Palo Alto, Calif.

[21] Appl. No.: 652,965

[22] Filed: Feb. 8, 1991

[51] Int. Cl.[5] ..... B41J 2/05; B41J 2/355

[52] U.S. Cl. ..... 346/1.1; 346/140 R; 346/76 PH; 400/120

[58] Field of Search ..... 346/140 R, 76 PH, 1.1; 400/120; 219/216

[56] References Cited

U.S. PATENT DOCUMENTS

| | | | |
|---|---|---|---|
| 4,587,530 | 5/1986 | Noguchi | 346/76 PH |
| 4,590,484 | 5/1986 | Matsushita | 346/76 PH |
| 4,590,488 | 5/1986 | Sullivan | 346/76 PH |
| 4,887,098 | 12/1989 | Hawkins et al. | 346/140 |
| 4,947,192 | 8/1990 | Hawkins et al. | 346/140 |

*Primary Examiner*—Benjamin R. Fuller
*Assistant Examiner*—Alrick Bobb

[57] ABSTRACT

A circuit for controlling the energy delivered to a heater resistor of a thermal inkjet printhead. The circuit includes a decoder for receiving an address for the heater resistor in a multiplexed environment. When the heater resistor is addressed, the output of the decoder is level shifted through a pair of inverters and transmitted to the gate of a PMOS driver that delivers the energy to the heater resistor. The PMOS driver responds to the voltage level of the adjacent inverter output in setting the level of the driver output voltage that is applied to the resistor. Feedback circuitry in the form of an analog or digital comparator compares the driver output voltage against a reference voltage. The comparator's output signal is fed back through the level shifter as the inverter output that is applied to the gate of the PMOS driver. The inverter output adjusts the driver output voltage so as to maintain the voltage across the heater resistor at a level that delivers a desired amount of energy to the heater resistor.

20 Claims, 3 Drawing Sheets

ENERGY CONTROL CIRCUIT FOR A THERMAL INK-JET PRINTHEAD

BACKGROUND OF THE INVENTION

This invention relates to thermal inkjet printing and more particularly to the energizing of heater resistors within an inkjet printhead to expel ink.

A thermal inkjet printhead comprises one or more ink-filled channels communicating with an ink supply chamber or cartridge at one end and having an opening at the opposite end, referred to as a nozzle. A heater resistor is located in the channel at a predetermined distance underneath the nozzle. The resistors are individually addressed with a current pulse to momentarily vaporize the ink to form a bubble. The bubble expels an ink droplet towards a recording medium such as paper. By energizing heater resistors in different combinations as the printhead moves across the paper, an inkjet printer prints different characters on the paper.

The heater resistors within the printhead are addressed through flexible conductors that connect the resistors to control circuitry within the thermal inkjet printer. In many prior systems, each resistor is connected directly to a flexible conductor. For a printer with relatively few resistors, this is a simple and efficient scheme. The base of an inkjet cartridge is large enough to accommodate the printhead as well as tab tape that holds conductive leads connecting each resistor to a flexible conductor. However, such printers print relatively slowly because the few resistors provide a narrow printing swath and have relatively poor resolution because the resistors provide few dots per inch (dpi). The number of resistors can be increased to some degree by increasing the number of individual conductive leads that may fit on the area of the cartridge base. But the process for doing so requires precise methods for reducing the width of the leads and their accurate placement on the tab tape, and is thus expensive.

An alternative to direct connection is multiplexing of the flexible conductors to reduce their number. With multiplexing, the output of a number of flexible conductor determines which resistors are to be heated. Referring to FIG. 1, there is shown a multiplexing scheme employed in U.S. Pat. No. 4,887,098. Logic control circuitry 14 in the printhead decodes the output of three flexible conductors for determining which heater resistor is to be energized. The outputs of the control circuitry 14 are connected directly to NMOS transistors that act as a drivers for controlling the current and thus the energy delivered to the heater resistors. Such gate transistors are required because typical logic control circuitry is not designed to source sufficient current for delivering sufficient energy to the heater resistors. The NMOS transistors enable the heater resistors to draw the needed energy from the power supply. With this scheme, up to eight resistors can be controlled through the three flexible conductors, greatly reducing the number of conductive leads required on the cartridge base.

Integrating transistors such as these NMOS gates into a printhead, however, introduces problems not present in the prior printers that employed direct connections. The characteristics of individual transistors may vary due to different mobilities over the process skew, variation in gate length, oxide thickness, etc. In addition, the voltages supplied to the transistor and the ambient temperature around the transistor may vary. These factors combine to cause fluctuations in the transistor output voltage and thus the amount of energy delivered to the heater resistor. The result is inconsistent print quality.

SUMMARY OF THE INVENTION

An object of the invention, therefore, is to provide a technique for controlling the energy delivered to heater resistors within an inkjet printhead which overcomes the drawbacks of the prior art.

Another object of the invention is to provide an elegant and cost-efficient control technique that is applicable to multiplexed printheads.

Yet another object of the invention is to provide such a technique that is applicable to printheads that utilize a transistor for controlling the energy delivered to a heater resistor.

In accordance with these objects, the invention comprises a circuit for controlling the energy delivered to and thus the heat generated by a heater resistor of a thermal inkjet printhead. The circuit includes transmitting means for receiving and transmitting a resistor energizing signal from the printer. Driver means responsive to the output signal of the transmitting means applies a driver output signal to the heater resistor to provide energy to the resistor. Feedback means then feed the driver output signal back to the transmitting means to adjust the driver output signal so that the driver means provides a desired amount of energy to the heater resistor. With the driver signal so adjusted, the heater resistor consistently generates a specified amount of heat each time it is energized.

The circuit of the invention may include a decoder for producing a digital signal that is received by the transmitting means. Where the digital signal has zero and five volt levels, the transmitting means may comprise a level shifter for shifting the magnitude of one of the signal levels for effectively controlling the driver means. The driver means may take the form of a transistor such as an NMOS or PMOS transistor. The feedback means may comprise a digital or analog comparator for comparing the driver output signal to a reference signal and producing in response an output signal. The comparator output signal is applied to the transmitting means to control the transmitted signal that is applied to the driver means.

The foregoing and other objects, features, and advantages of the invention will become more apparent from the following detailed description of the preferred embodiments which proceed with reference to the accompanying drawings.

DESCRIPTION OF SEVERAL PREFERRED EMBODIMENTS

Figure 1:
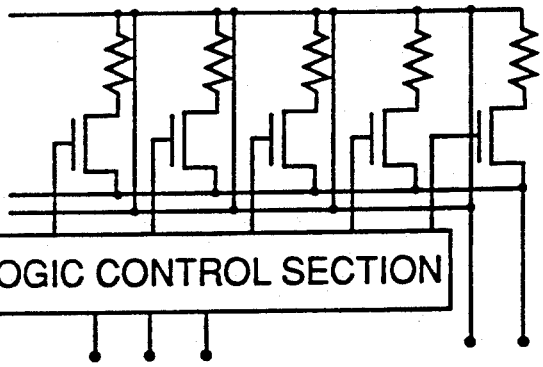
FIG. 1 Prior Art
FIG. 1 is a schematic diagram of prior art circuit for multiplexing the flexible conductors that control the energizing of heater resistors within a thermal inkjet printhead.
Figure 2:
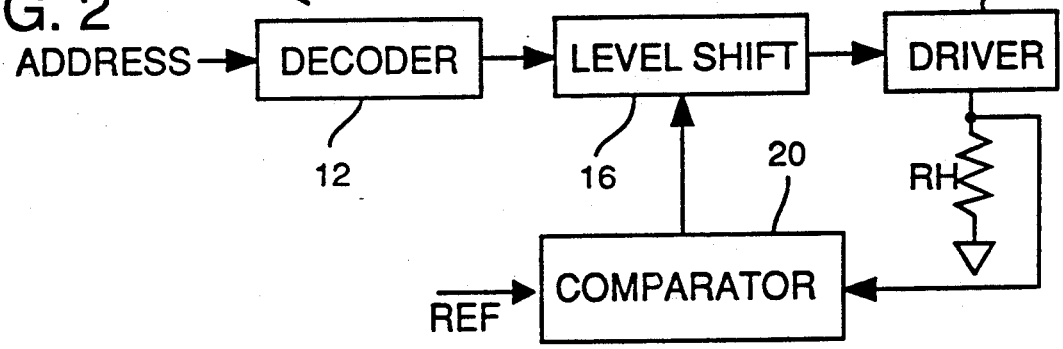
FIG. 2 is a block diagram of a circuit according to the invention.

Referring now to FIG. 2, there is shown a block diagram of a circuit 10 according to the invention for controlling the energy delivered to a heater resistor RH within a thermal inkjet printhead. The circuit 10 is replicated within the printhead for each heater resistor. The circuit includes a decoder 12 that may be part of a larger multiplexing circuit for determining which heater resistor is to be energized. For example, the address may comprise a four-bit word transmitted from the control circuitry of the printer by four flexible conductive lines to a multiplexing circuit on the printhead. These four lines are then capable of individually addressing up to $2^4$ (sixteen) different heater resistors. Multiplexing of the flexible lines is known in the art, as shown in FIG. 1, wherein the logic control section 14 performs a multiplexing function.

The state of the output signal of the decoder 12 determines if the heater resistor RH is to be energized. In contemplated use, the decoder 12 is part or a digital multiplexing circuit and the output signal is digital in nature with one signal level being about zero volts and the other signal level being about five volts. The decoder output signal is received by a transmitting means such as the level shifter 16 for further transmission to means such as a resistor driver 18. The driver 18 is responsive to the transmitted signal of the level shifter 16 for applying a driver output signal to the resistor RH to provide energy to the heater resistor. The resistor is connected at one end to the output of the driver 18 and at the other end to ground. The level of the driver output signal is a function of the level of the transmitted signal and the level of the power supply for the driver.

As mentioned in the background, the output signal of a driver 14 may vary in response to a given transmitted signal applied to it. This variation may be due to ambient temperature changes. Moreover, each driver 14 within a printhead may produce output signals of different magnitude even under the same operating conditions because of variations in the driver construction introduced in the fabrication process. To adjust the driver output signal so that the driver means provides a specified amount of energy to the resistor RH, feedback is employed. Feedback means such as a comparator 20 is coupled to the one end of resistor RH. From that connection comparator 20 receives the driver output signal, compares it against a reference signal and produces in response a comparator output signal. The comparator output signal is then communicated to the level shifter 16. Through its output signal, the comparator 20 adjusts the level of the transmitted signal applied to the driver 18. The level of the transmitted signal applied to the driver 18, in turn, adjusts the level of the driver output signal applied to resistor RH and hence the amount of energy delivered to the resistor.

In FIG. 2 the transmitting means is represented as level shifter 16, although the invention is not limited to this particular structure. The level shifter 16 is present because the levels of the decoder output signal, typically zero and five volts, are not sufficiently great to completely control the driver 18. The need for such level shifting when decoder 12 produces signals of these levels will become apparent from the following description of preferred embodiments of the invention. It should be clear to those skilled in the art, however, that the level shifting function of the transmission means is not required if the decoder 12 produces output signals of sufficient levels to control the driver 18. In that event, the transmission means may comprise possibly a buffer that does not level shift and yet whose transmitted signal is adjusted by the comparator 20 as described above.

It should also be emphasized that the comparator 20 is a functional description of a part of the circuit 10 and is not meant to be a limitation as to structure. The term "comparator" is often used in the art to describe an operational amplifier whose output signal increases if the magnitude of the signal applied to the noninverting input is greater than the magnitude of the signal applied to the inverting input and whose output decreases if the reverse is true. While comparator 20 encompasses such structure, it is not limited to it, as will become apparent the description of a second embodiment of circuit 10.

Figure 3:
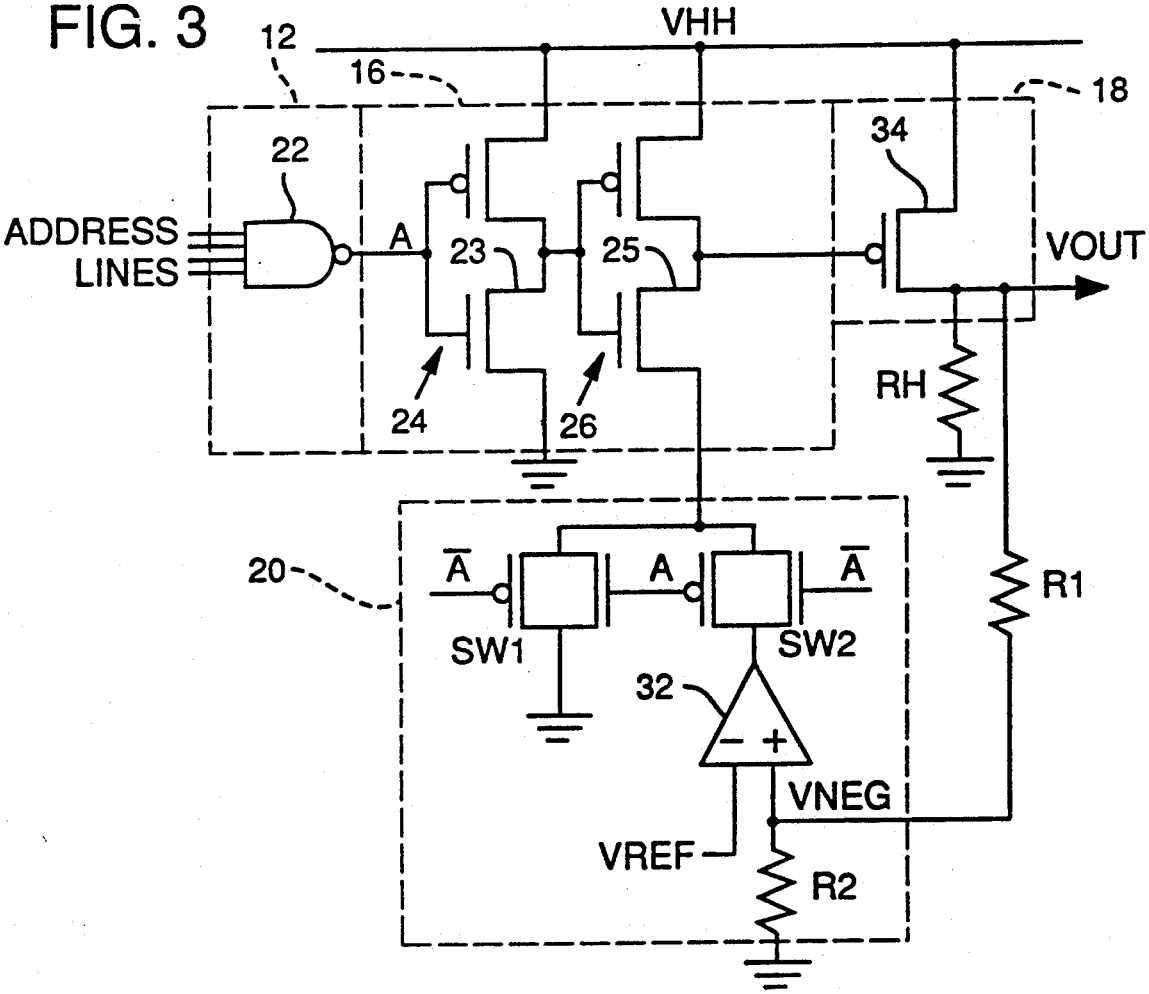
FIG. 3 is a schematic diagram of a first embodiment of the circuit of FIG. 2.

Referring now to FIG. 3, there is a schematic diagram shown of one embodiment of circuit 10. Decoder 12 in this embodiment is shown as a NAND gate 22 that produces a high (logic level 1) output digital signal if any of its inputs are low (logic level 0) and a low output digital signal if all of its inputs are high. In the present embodiment, a low output signal indicates that the heater resistor is to be energized and a high output signal indicates that it is not. NAND gate 22 as conventionally constructed produces a five volt high signal and a zero volt low signal, standard for CMOS digital logic.

The output signal of gate 22 is received by the level shifter 16 which comprises a pair of CMOS inverters 24 and 26. The symbol for the PMOS transistors in FIG. 3 is a circle attached to the transistor gate. The two inverters 24 and 26 shift the high output signal from five volts to the level of the power supply VHH in order that the transmitted signal applied to the driver 18 can fully control the driver. The source of the NMOS transistor 23 of inverter 24 is permanently grounded while the source of the NMOS transistor 25 of inverter 26 is coupled to a pair of CMOS switches SW1 and SW2. CMOS switches are employed to ensure that a signal within the range of zero to five volts may pass through the switch. Switch SW1 closes to connect the transistor 25 source to ground when the output signal of NAND gate 22 is high and the heater resistor is not to be energized. Switch SW2 is open under this condition. Switch SW2 closes to connect the transistor 25 source to a comparator 32 when the resistor RH is to be energized, completing the feedback loop. Switch SW1 is open under this condition. Comparator 32 as connected in the embodiment is one form of feedback means, as will be described.

Driver 18 in FIG. 3 is a PMOS transistor 34 integrated with the printhead, with VHH applied to its source, the output of inverter 26 applied to its gate, and the driver output signal (VOUT) present at its drain. VHH is of a magnitude, typically ten to twenty volts, sufficient to produce a driver output signal of the desired energy-delivering voltage when the transistor 34 is conducting (on). Without the level shift provided by the inverters 24 and 26, the high output signal when applied to the gate of transistor 34 would be insufficient to fully shut off the transistor. Alternatively, if driver 18 were an NMOS transistor, the high output signal would be level shifted so that is could fully turn on the transistor.

When heater resistor RH is not addressed, therefore, NAND gate 22 produces a high output signal that is then level shifted by inverters 24 and 26 and applied to the gate of transistor 34 to fully shut off the transistor.

The driver output signal voltage is zero and heater resistor RH is not energized. Switch SW1 is closed to connect the NMOS transistor 25 of the inverter 26 to ground and switch SW2 is open to break the feed back loop through comparator 32.

When resistor RH is addressed, NAND gate 22 produces a low output signal which initially turns on the transistor 34. Switch SW1 is now opened and switch SW2 is now closed to connect the NMOS transistor 25 of the inverter 26 to the output of comparator 32, completing the feedback loop. The driver output voltage is now fed back through comparator 32 and transistor 25 to adjust the voltage level of the signal transmitted from the inverter 26 to the gate of transistor 34. The change in the voltage applied to the gate of transistor 34 in turn adjusts the driver output voltage. This continuous adjustment maintains the driver output voltage at a desired level that causes the transistor 34 to provide the specified energy to heater resistor RH.

The feedback process may be best understood by example. With heater resistor RH addressed by the control circuitry within the thermal printer, NAND gate 22 produces a low output signal that is inverted, level shifted to the power supply level, and applied to the gates of inverter 26. This renders the NMOS transistor 25 conductive. The low output signal from NAND gate 22 opens switch SW1 and closes switch SW2. Transistor 25 passes the comparator output voltage through the inverter 26 output to the gate of transistor 34. With transistor 34 initially off, the comparator output voltage is low and this low voltage turns on transistor 34. The driver output voltage (VOUT) increases from zero and is applied across resistor RH. VOUT is also applied to the noninverting input of comparator 32, scaled appropriately by a voltage divider comprising resistors R1 and R2. The scaling is done as a matter of convenience because the reference voltage (VREF) applied to the inverting input of comparator 32 is the band gap voltage of about 1.2 volts and is available within the circuit. With a higher reference voltage the voltage divider may be unnecessary.

If VOUT, as scaled, exceeds VREF, then the voltage across resistor RH is too high and must be reduced. Comparator 32 responds by producing an output voltage that moves toward five volts. Switch SW2, being a CMOS switch, transmits the comparator output voltage without hindrance to the transistor 25. This increasing voltage is transmitted through transistor 25 to the gate of transistor 34. Because transistor 34 is PMOS, the increasing gate voltage reduces VOUT and thus the energy delivered to resistor RH.

If VOUT, as scaled, is less than VREF, the voltage across resistor RH is too low and must be increased. Comparator 32 responds by moving its output voltage towards zero volts. This decreasing voltage is also transmitted through transistor 25 to the gate of transistor 34. The decreasing voltage increases VOUT and thus the energy delivered to resistor RH.

The described voltage adjustment process is continuous to maintain a constant VOUT. As VOUT attempts to vary in response to temperature changes and other influences, the comparator 32 responds by changing its output voltage to bring VOUT back to the desired level. The comparator output voltage in this embodiment can only swing from zero to five volts. The circuit thus must be designed such that the minimum VOUT, which is reached when the comparator output voltage is at its maximum, is equal to or less than the desired energy delivering voltage.

Figure 4:
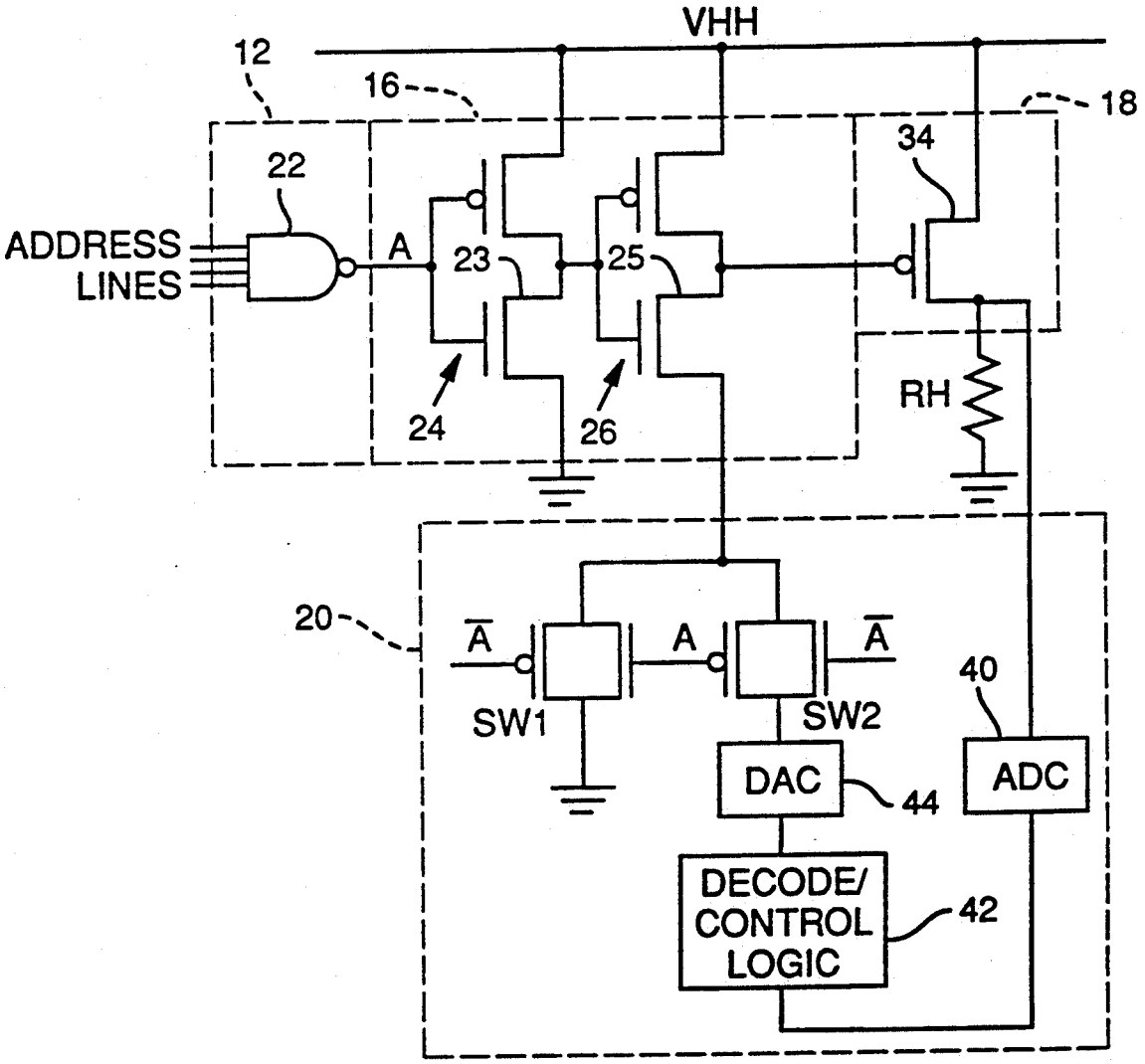
FIG. 4 is a schematic diagram of a second embodiment of the circuit of FIG. 2.

Referring now to FIG. 4, there is shown a second embodiment of a circuit according to the invention. In this embodiment, the feedback means comprises an analog to digital converter (ADC) 40, decode/control logic 42 and a digital-to-analog converter (DAC) 44. ADC 40 is coupled to the output of the transistor 34 for converting the driver output voltage (VOUT) to a digital signal. Logic 42 is a comparator means for comparing the digitized VOUT against a digital reference signal and producing a digital output correction signal in response. The digital output signal is applied to the DAC 44 for conversion to an analog correction voltage. The DAC 44 is coupled to the source of transistor 25 and the analog voltage is transmitted through the transistor to the gate of transistor 34.

The feedback circuitry in the embodiment shown in FIG. 4 is a digital equivalent to the feedback circuitry in the embodiment in FIG. 3 and works in a similar manner.

In thermal inkjet printheads, the heater resistors are organized into defined groups known as primitives, as illustrated in FIG. 1, in which only one heater resistor may be active at one time. Each primitive has a common ground line which is coupled to the member heater resistors at separate ground nodes. The resistance of the ground line is negligible and thus the current flowing through a single active heater resistor into the ground line at a ground node does not produce a significant voltage at the node. For example the electrical potential or voltage at one ground node is substantially equal to the voltage at the adjacent ground node. Thus the energy delivered to the heater resistor is essentially a function of VOUT and the resistance of the resistor.

As the number of primitives grows to increase the swath and resolution of the printhead, the number of ground lines increases. Simply combining ground lines for different primitives to reduce their number is not a satisfactory solution. Heater resistors from different primitives often fire simultaneously, each causing current to flow through the ground line. Even with the negligible resistance of the ground line, the combined currents flowing through a single ground line would change the ground potential at the ground nodes for different resistors. The ground potential at each ground node may vary depending on the number of heater resistors active at one time. With VOUT held constant by the feedback circuitry described above, the voltage across each heater resistor would change and thus the energy delivered to the heater resistor would change.

Figure 5:
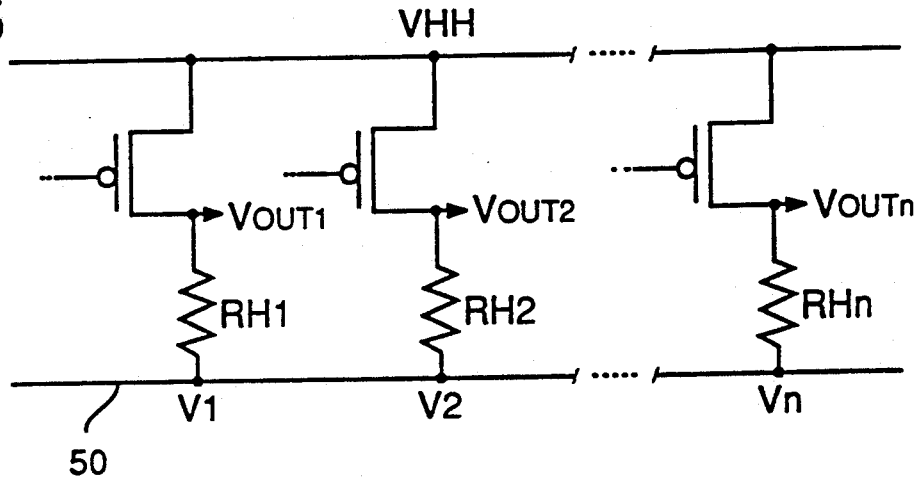
FIG. 5 is a schematic diagram of a circuit in which a number of heater resistors share a common ground line.

For example, assume that FIG. 5 represents heater resistors RH1-RHn from a number of primitives that all utilize a single ground line 50. To simplify the figure, only the driver transistors and heater resistors are shown. The voltage Vn at the ground node of resistor RHn would be higher than the voltage V1 at the ground node of resistor RH1 if several heater resistors were simultaneously contributing current to the ground line 50. The voltage across resistor RHn (VOUTn-Vn) would thus be less than the voltage across resistor RH1 (VOUT1-V1) and the energy delivered to the two resistors would vary. More importantly, even the voltage across a single heater resistor would vary as a function of the number of heater resistors active at the time.

Figure 6:
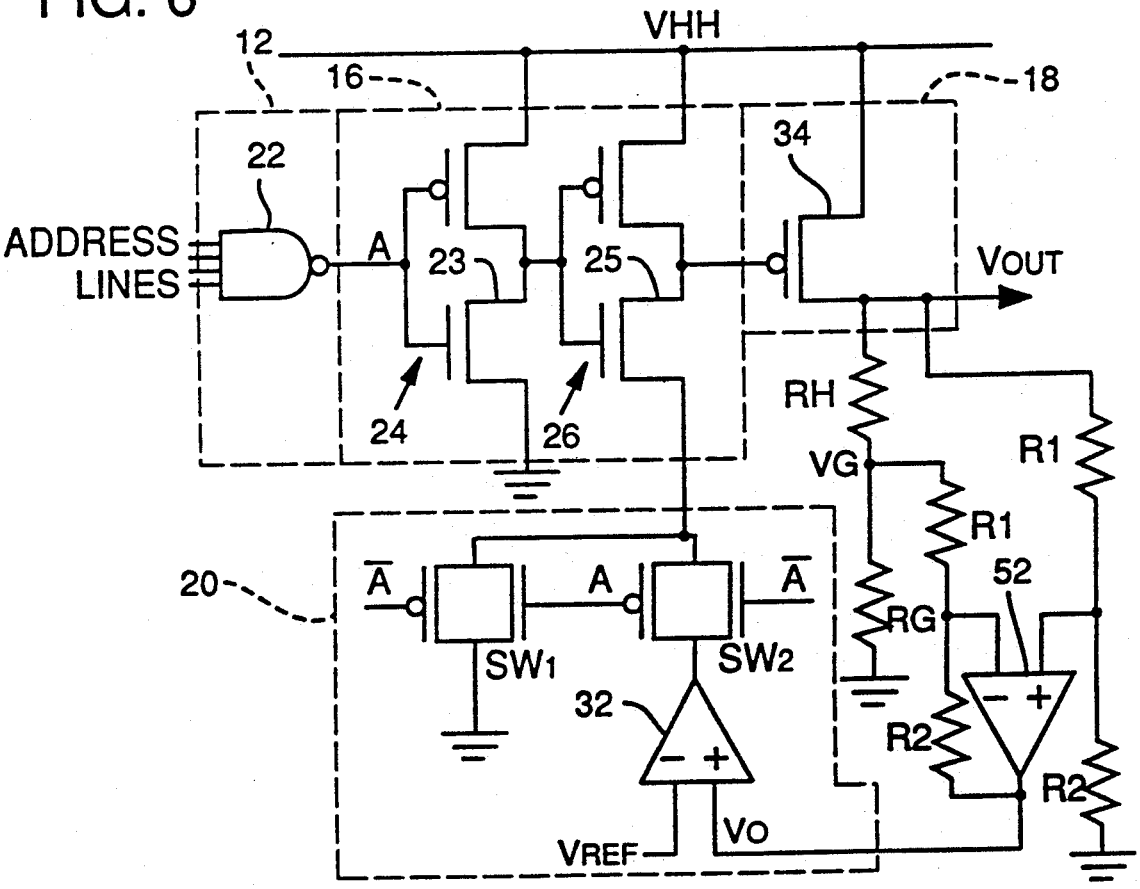
FIG. 6 a schematic diagram of a third embodiment of the circuit of FIG. 2 for use with heater resistors that share a common ground line.

FIG. 6 illustrates a circuit design that overcomes this drawback of combining ground lines. The resistance of the ground line 50 is represented as a resistor RG. The signal present at the ground node between resistor RH and resistor RG is a voltage VG. VOUT and VG are applied to the noninverting and inverting inputs, respectively, of an operational amplifier 52 configured as a difference amplifier. The output Vo of the difference amplifier is the difference between the two voltages multiplied by the ratios of resistors R1 and R2:

$$Vo = R2/R1\ [VOUT - VG]$$

R1 and R2 are chosen to scale Vo to a desired magnitude for comparison against VREF. If R1 equals R2, then Vo is simply the difference between the two voltages. Vo is applied to the noninverting input of comparator 32 for comparison against a reference voltage VREF. As in the other embodiments, the comparator produces in response an output signal that is applied to the source of transistor 25 to control the level of the transmitted signal applied to the driver transistor 34.

Rather than feeding the driver output voltage VOUT back to the level shifter 16 as in the other embodiments, the circuit of FIG. 6 thus feeds back the difference between VOUT and VG. It is the feedback of this difference that causes the transmitting means to adjust the driver output signal so as to maintain a predetermined difference in signals across the heater resistor. If VG changes, then VOUT is adjusted via the feedback circuitry to match the change so that the voltage dropped across resistor RH remains constant. The predetermined difference is selected to deliver the desired amount of energy to the resistor RH in response to a printer control signal and is a function of the values of resistors R1, R2 and the reference voltage VREF.

The difference means for obtaining the difference between VOUT and V2 may be one of many equivalent devices known to those skilled in the art. For example, the difference means may comprise an instrumentation difference amplifier or, as in the present embodiment, a difference amplifier constructed from an operational amplifier 52.

Having illustrated and described the principles of the invention in the preferred embodiments, it should be apparent to those skilled in the art that the invention can be modified in arrangement and detail without departing from such principles. For example, the equivalent circuits may employ current as signals rather than voltage or may be fabricated with bipolar circuits. We therefore claim all modifications coming within the spirit and scope of the following claims.

We claim:

1. A circuit for controlling energy delivered to a heater resistor of a thermal inkjet printhead, comprising:

transmitting means for receiving a printer control signal and for transmitting a transmitted signal for energizing the heater resistor;

driver means responsive to the transmitted signal for applying a driver output signal to the heater resistor to provide energy to the heater resistor; and feedback means for feeding the driver output signal back to the transmitting means to cause the transmitting means to adjust the driver output signal whereby the driver means provides a desired amount of energy to the heater resistor, the circuit thereby controlling the energy delivered to the heater resistor to generate heat.

2. The circuit of claim 1 wherein the driver output signal is a voltage that is adjusted to maintain a specified voltage across the heater resistor in response to the printer control signal.

3. The circuit of claim 1 including a decoder for producing a digital control signal received by the transmitting means, the transmitting means producing the transmitted signal in response.

4. The circuit of claim 1 wherein the transmitting means comprises a level shifter means for shifting the level of the printer control signal to a level sufficient to control the driver means.

5. The circuit of claim 4 wherein the level shifter means comprises a pair of inverters.

6. The circuit of claim 1 wherein the feedback means comprises a comparator means for comparing the driver output signal against a reference signal and producing in response a comparator output signal which is applied to the transmitting means to control the level of the transmitted signal applied to the driver means.

7. The circuit of claim 6 wherein the feedback means includes a pair of resistors to scale the driver output signal applied to the comparator means for comparison to the reference signal.

8. The circuit of claim 1 wherein the feedback means comprises:

an analog to digital converter means for converting the driver output signal to a digital signal;

comparator means for comparing the digitized driver output signal against a digital reference signal, the comparator means producing a digital output signal in response; and a digital to analog converter means for converting the digital output signal to an analog output signal, the analog output signal applied to the transmitting means to control a level of the transmitted signal applied to the driver means.

9. The circuit of claim 1 wherein the feedback means further comprises difference means for obtaining a difference between the driver output signal applied to one end of the heater resistor and a second signal present at another end of the heater resistor, the difference in signals being fed back to the transmitting means to cause the transmitting means to adjust the driver output signal so as to maintain a predetermined difference in signals across the heater resistor.

10. The circuit of claim 9 including a comparator to determine the difference between the driver output signal and the second signal against a reference signal and producing n response of a comparator output signal applied to the transmitting means to control the level of the transmitted signal applied to the driver means.

11. The circuit of claim 1 including a switch coupled between the transmitting means and feedback means for controlling the feedback of the driver output signal to the transmitting means.

12. The circuit of claim 11 wherein the switch comprises a CMOS switch.

13. The circuit of claim 1 wherein the driver means comprises a transistor integrated within the inkjet printhead.

14. A circuit for controlling energy delivered to a heater resistor of a thermal inkjet printhead, comprising:

level shifter means for receiving a printer control signal and for shifting a voltage level of the printer control signal resulting in an output signal;

driver means, responsive to the output signal of the level shifter means, for applying a driver output voltage to the heater resistor to provide energy to the resistor; and comparator means for comparing the driver output voltage against a reference voltage and producing in response a comparator output signal, the comparator output signal communicated to the level shifter means to adjust the driver output voltage so as to maintain a voltage across the heater resistor at a level for providing a desired amount of energy to the heater resistor.

15. The circuit of claim 14 wherein the driver means comprises a transistor integrated into the inkjet printhead.

16. A circuit for controlling energy delivered to a heater resistor of a thermal inkjet printhead, comprising:

level shifter means for receiving a printer control signal and for shifting a voltage level of the printer control signal resulting in an output signal;

driver means responsive to the output signal of the level shifter means, for applying a driver output voltage to the heater resistor to provide energy to the resistor;

difference means for obtaining a voltage across the heater resistor; and comparator means for comparing the voltage across the heater resistor against a reference voltage and producing in response a comparator output signal, the comparator output signal communicated to the level shifter means to adjust the driver output voltage so as to maintain the voltage across the heater resistor at a level for providing a desired amount of energy to the heater resistor.

17. The circuit of claim 16 wherein the difference means comprises a difference amplifier.

18. The circuit of claim 16 wherein the driver means comprises a transistor integrated into the inkjet printhead.

19. A method for controlling energy delivered to a heater resistor of a thermal inkjet printhead, comprising the steps of:

applying a signal to the heater resistor to provide said heater resistor with energy;

comparing the applied signal against a reference signal to determine if the applied signal is providing the desired amount of energy; and in response to the comparison, adjusting the applied signal so that the applied signal provides the heater resistor with the desired amount of energy.

20. The method of claim 19 wherein the applied signal is a voltage and the step of comparing the applied signal includes comparing a magnitude of a voltage across the heater resistor against a reference voltage.

* * * * *